US007334838B2

(12) United States Patent
Pope

(10) Patent No.: US 7,334,838 B2
(45) Date of Patent: Feb. 26, 2008

(54) BEVERAGE ARM REST

(76) Inventor: Allen Ray Pope, 21 Benwell Rd., Reisterstown, MD (US) 21136

( * ) Notice: Subject to any disclaimer, the term of this patent is extended or adjusted under 35 U.S.C. 154(b) by 0 days.

(21) Appl. No.: 11/485,132

(22) Filed: Jul. 12, 2006

(65) Prior Publication Data

US 2007/0013214 A1 Jan. 18, 2007

Related U.S. Application Data

(60) Provisional application No. 60/698,360, filed on Jul. 12, 2005.

(51) Int. Cl.
*A47C 7/62* (2006.01)
*A47C 7/54* (2006.01)

(52) U.S. Cl. ..... 297/188.14; 297/188.01; 297/188.19; 297/188.2; 297/411.23; 297/411.24; 297/411.46; 297/183.1

(58) Field of Classification Search ..... 297/188.14, 297/188.01, 188.2, 188.19, 411.23, 411.24, 297/411.46, 183.1, 183.5
See application file for complete search history.

(56) References Cited

U.S. PATENT DOCUMENTS 2,006,883 A * 7/1935 Davies et al. ..... 297/188.19 X
2,692,638 A * 10/1954 Castell ..... 297/188.19 X
3,083,998 A * 4/1963 Morris ..... 297/188.19 X
3,118,704 A * 1/1964 Meserve ..... 297/188.19 X
4,106,829 A 8/1978 Dolle et al.
D267,444 S 1/1983 Ruxton
4,512,503 A * 4/1985 Gioso ..... 297/188.2 X
4,858,995 A * 8/1989 Young ..... 297/411.23
5,246,269 A * 9/1993 DeBoer et al. ..... 297/411.46 X
5,429,416 A * 7/1995 Lofy ..... 297/411.23
5,527,091 A * 6/1996 Gruber ..... 297/188.01
5,580,125 A * 12/1996 Alger ..... 297/188.04 X
5,687,651 A * 11/1997 Hurayt et al. ..... 297/188.01 X
5,911,472 A * 6/1999 Toth ..... 297/188.2
6,142,574 A * 11/2000 Alexander ..... 297/411.24 X
6,152,514 A * 11/2000 McLellen ..... 297/411.24 X
6,279,798 B1 * 8/2001 Partch et al. ..... 297/188.2 X
6,371,641 B1 * 4/2002 Wilson, Jr. ..... 297/188.01 X
6,929,325 B1 * 8/2005 Goelo ..... 297/219.1
7,165,808 B2 * 1/2007 Harland et al. ..... 297/188.01

FOREIGN PATENT DOCUMENTS

DE 3143957 A1 * 5/1983 ..... 297/188.2

* cited by examiner

*Primary Examiner*—Rodney B. White
(74) *Attorney, Agent, or Firm*—James Ray & Assoc.

(57) ABSTRACT

A portable apparatus for use as an armrest and for holding a beverage container. The apparatus comprises an elongated generally hollow member having each of a predetermined configuration a predetermined depth and formed of a predetermined material. A foam material is disposed within the elongated generally hollow member. At least one cup like member having an open end is disposed adjacent an upper surface of such elongated member and a closed end is disposed within such elongated member and surrounded by the foam material for use as a holder for a beverage container. There is a means for closing such elongated member after the foam material has been added and also a means for securing the cup like member to such elongated member.

17 Claims, 3 Drawing Sheets

BEVERAGE ARM REST

CROSS REFERENCE TO RELATED APPLICATIONS

This application is closely related to and claims benefit from U.S. Provisional Application Ser. No. 60/698,360 filed Jul. 12, 2005.

FIELD OF THE INVENTION

The present invention relates, in general, to a portable arm rest, and, more particularly, the present invention relates to a portable arm rest that can be used virtually everywhere that is designed to also hold beverage containers.

BACKGROUND OF THE INVENTION

When a person is lounging on a sofa, in bed, on the floor or by the pool often there is a need for a safe stable area on which to place a beverage. Relaxing with the use of an armrest is convenient, yet many pieces of indoor or outdoor furniture do not feature an armrest. Some furniture, like a sofa, provides an armrest on each of the ends; however, very few of them come with a center arm rest which could be shared by two individuals. Further, these armrests, as well as many armrests that are available on outside furniture do not lend themselves to being suitable for holding a beverage container in a secure manner.

Thus, when lounging whether there is an armrest available or not there seems to always be a need for a device which can be used to hold a container secure enough that there is no danger of spillage. It would be advantageous if there were some item which could be used for securing a beverage container wherever a person would want to lounge whether lying down or sitting.

SUMMARY OF THE INVENTION

In a first aspect the present invention provides a portable apparatus for use as an armrest and for holding a beverage container. The apparatus comprises an elongated generally hollow member having each of a predetermined configuration a predetermined depth and formed of a predetermined material. A foam material is disposed within the elongated generally hollow member. At least one cup like member having an open end is disposed adjacent an upper surface of such elongated generally hollow member and a closed end is disposed within such elongated generally hollow member and surrounded by the foam material for use as a holder for a beverage container. There is a means for closing such elongated generally hollow member after the foam material has been added and also a means for securing the cup like member to such elongated generally hollow member.

OBJECTS OF THE INVENTION

It is, therefore, one of the primary objects of the present invention to provide a freestanding armrest.

Another object of the present invention is to provide a freestanding armrest that also can be used to hold beverages.

Still another object of the present invention is to provide a freestanding armrest that is portable.

Yet another object of the present invention is to provide a freestanding armrest that can be used on a sofa or in bed.

It is another object of the present invention to provide a freestanding armrest that has a bottom filled with pellets so as to conform in shape to virtually any surface.

These and various other objects and advantages of this invention will become apparent after a full reading of the following detailed description, particularly, when read in conjunction with the attached drawings as described below and the appended claims.

Figure 1:
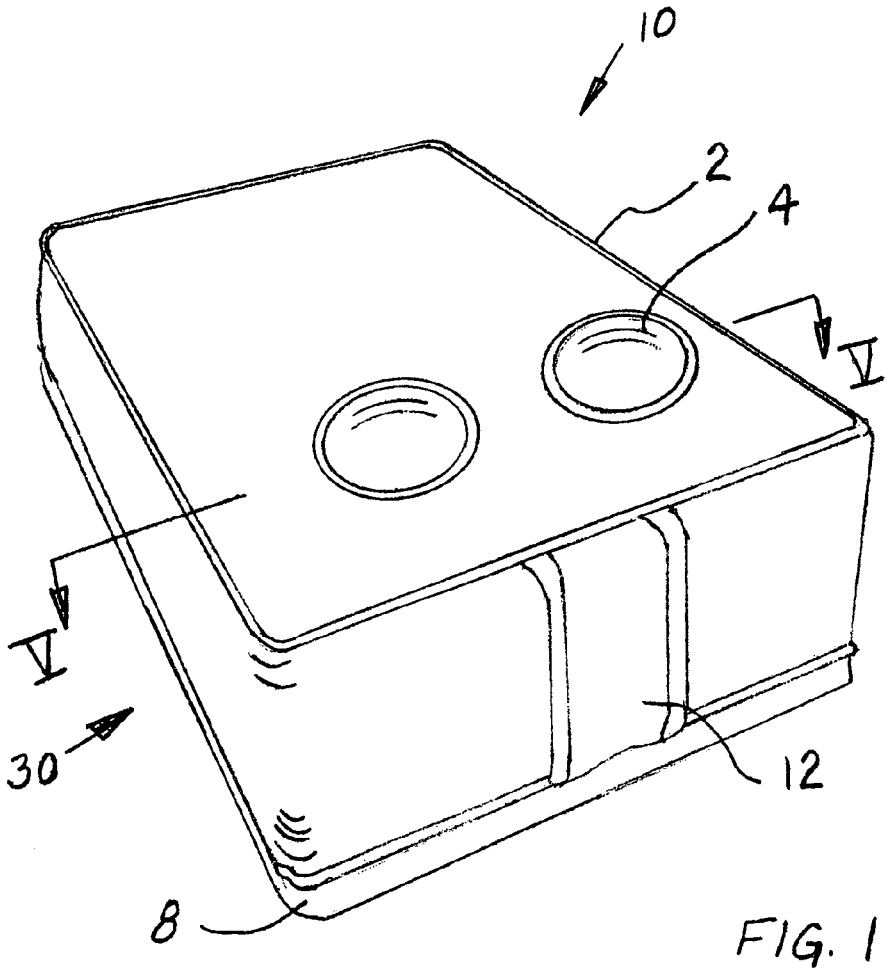
FIG. 1 is a perspective view of the apparatus according to an embodiment of the invention showing the armrest with two cup holders.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides a portable apparatus, generally designated 10, for use as an armrest and for holding a beverage container. The apparatus 10 comprises an elongated generally hollow member 2 having each of a predetermined configuration, a predetermined depth and formed of a predetermined material. A foam material is disposed within the elongated generally hollow member 2. At least one cup like member 4 having an open end disposed adjacent an upper surface of such elongated generally hollow member 2 and a closed end disposed within such elongated generally hollow member 2 and surrounded by the foam material for use as a holder for a beverage container 6. There is a means, generally designated 20, for closing such elongated generally hollow member 2 after the foam material has been added and also a means, generally designated 30, for securing the cup like member 4 to such elongated generally hollow member 2.

Such predetermined configuration of the elongated generally hollow member 2 is substantially rectangular.

Such elongated generally hollow member 2 is formed from a plastic material. It is presently preferred that such plastic material is vinyl, resembling Naugahyde.

There is also a generally hollow base member 8 which is disposed on a bottom portion of the elongated generally hollow member 2. Such generally hollow base member 8 is filled with a preselected granular material so as to substantially conform in shape of any surface which the apparatus 10 is placed on. Such preselected granular material is selected from a group including pellets, peas, beans, and dried corn. It is presently preferred that such granular material is pellets and, further, that such pellets are made of polypropylene.

As seen in FIG. 1 such apparatus 10 further includes a carrying handle 12. Such handle 12 is disposed on an end of such generally hollow member 2 of such apparatus 10.

Figure 2:
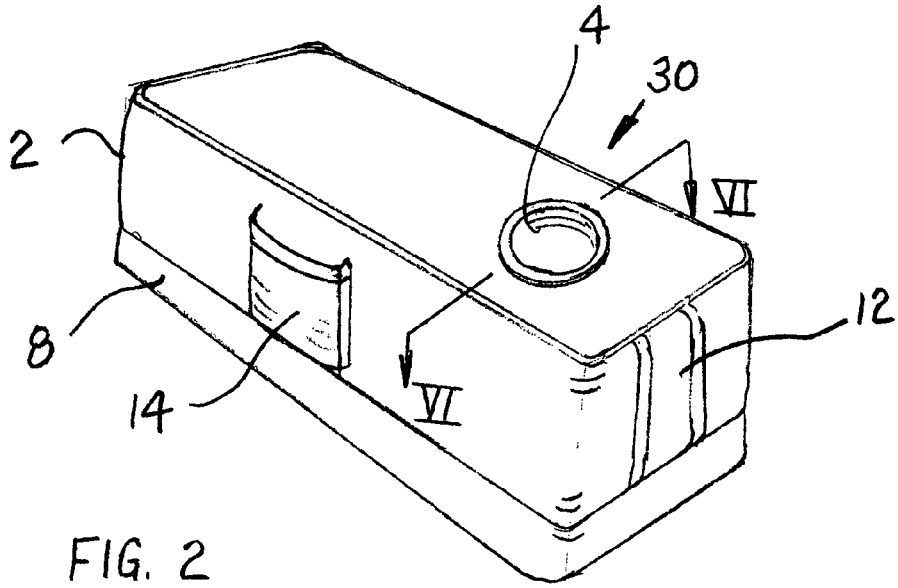
FIG. 2 is a perspective view of the apparatus according to an alternate embodiment showing an armrest for one with a single cup holder.
Figure 3:
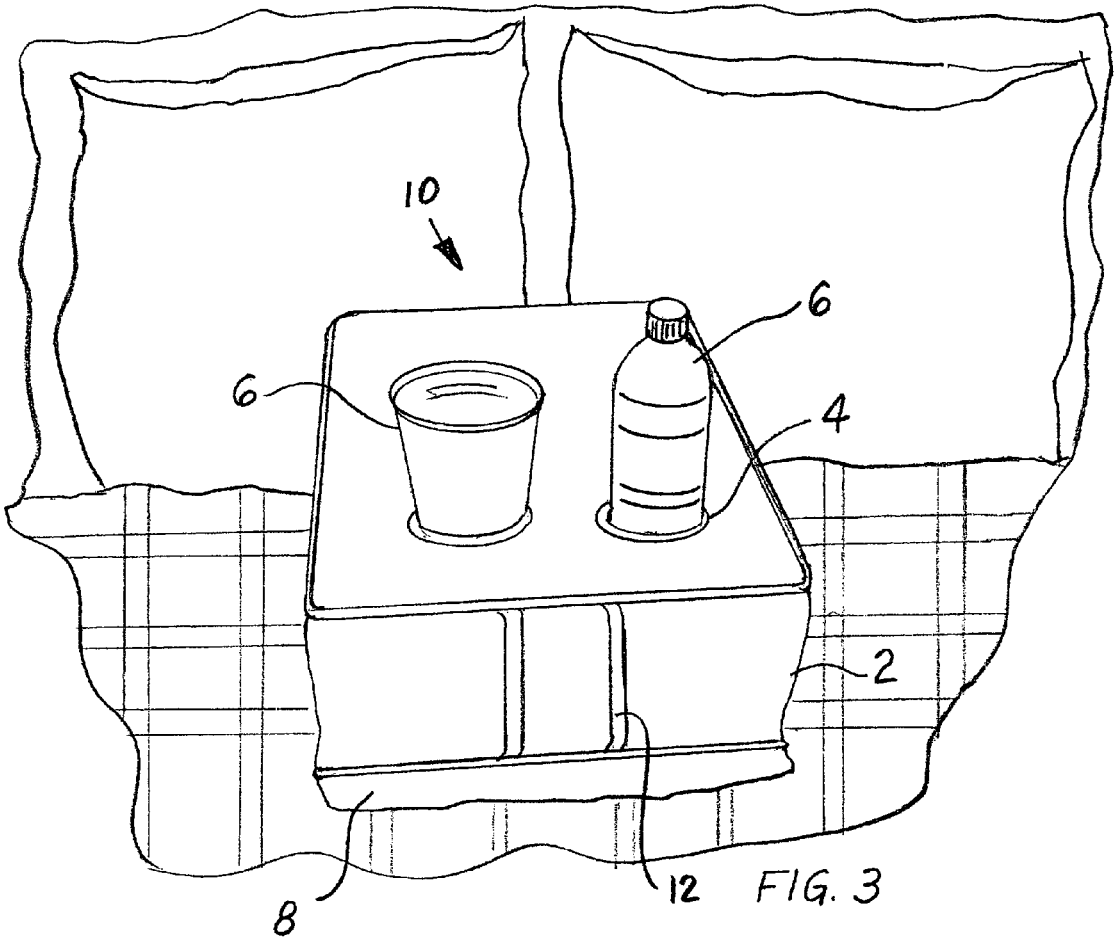
FIG. 3 is a perspective view of the apparatus shown in FIG. 1 placed on a bed for use by two persons.
Figure 4:
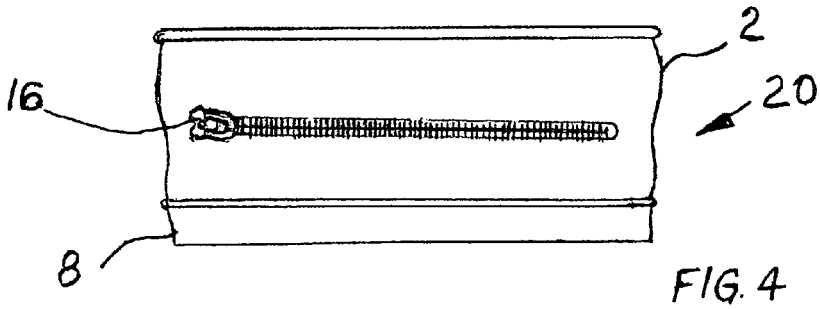
FIG. 4 is a perspective view of the back of the apparatus shown in FIG. 1.
Figure 5:
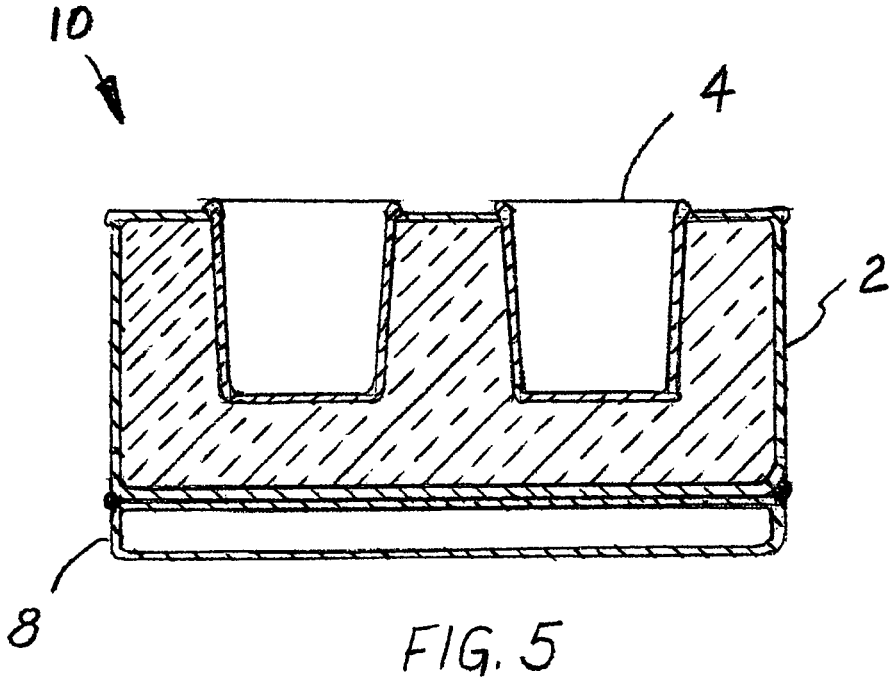
FIG. 5 is a cross sectional view of FIG. 1 taken across the line V-V.
Figure 6:
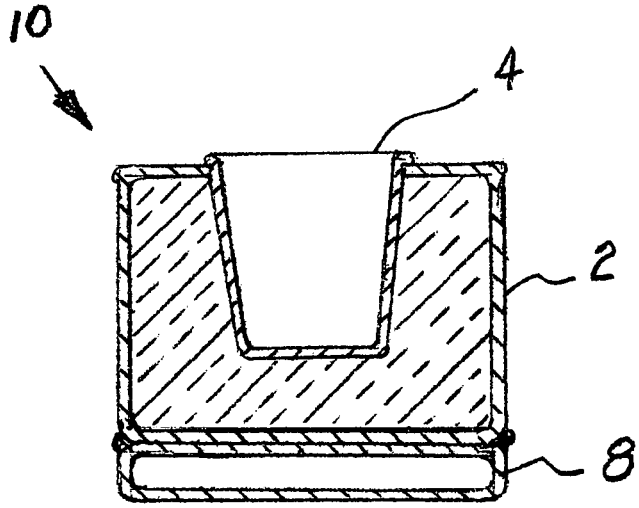
FIG. 6 is a cross sectional view of FIG. 2 taken across the line VI-VI.

Such means 20 for closing such elongated generally hollow member 2 includes at least one of sewing and a zipper 16. It is presently preferred that such closing means 20 is a zipper 16. Also, it is presently preferred that such means 30 for securing such cup like member 4 to the elongated generally hollow member 2 is an adhesive. As is evident in FIG. 1 it is preferred that such apparatus 10 have two cup like members 4. This will permit such apparatus 10 to be placed on a sofa, lounge or bed between two persons and each would have their own cup holder. As seen in FIG. 1 such cup like members 4 are disposed substantially adjacent each other on a same end of the elongated generally hollow member 2. Also as seen in FIG. 2 such apparatus 10 may also have a pouch 14 on a side of the elongated generally hollow member for holding different items.

Such foam material that is disposed within such generally hollow member 2 is selected from one of polystyrene foam and polyurethane foam. It is preferred that such foam material is polystyrene.

Thus, the present invention provides users with a portable arm rest that can easily hold beverages and could alternatively be used as a pillow just by turning the arm rest over. It was designed as a freestanding armrest having the ability to hold beverages. The portable armrest can be taken from area to area, from a sofa to a loveseat or any area that lacks an armrest. It is suitable for lounging in bed or on the floor. It can even be used in an automobile that does not have an armrest or cup holder or other locations that are not appropriate to place a beverage container.

It is within the scope of the invention that such cover portion of the arm rest could consist of a variety of materials; however, as stated previously it is preferred that such material be vinyl, such as Naugahyde. Such cover could come in a variety of colors and also a variety of sizes. The beverage holders are conveniently placed in the apparatus so that two persons could utilize the arm rest and cup holders simultaneously, without any difficulty. Since the base of the apparatus is filled with pellets, similar to a beanbag chair, such apparatus can conform in shape to virtually any surface upon which the apparatus is placed. Such a unit can be used indoors or outdoors and in any area that requires a quick and convenient arm rest or beverage holder.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. A portable apparatus for use as an armrest and for holding a beverage container, said apparatus comprising;

(a) an elongated generally hollow member having each of a predetermined configuration, a predetermined depth and formed of a predetermined material;

(b) a foam material disposed within said elongated generally hollow member;

(c) at least one cup holding member having an open end disposed adjacent an upper surface of said elongated generally hollow member and a closed end disposed within said elongated generally hollow member and surrounded by said foam material for use as a holder for a beverage container;

(d) a means for closing said elongated generally hollow member after said foam material has been added;

(e) a means for securing said cup holding member to said elongated generally hollow member; and (f) a generally hollow base member disposed on a bottom portion of said elongated generally hollow member.

2. The portable apparatus, according to claim 1, wherein said predetermined configuration is substantially rectangular.

3. The portable apparatus, according to claim 1, wherein said elongated generally hollow member is formed from a plastic material.

4. The portable apparatus, according to claim 3, wherein said plastic material is vinyl.

5. The portable apparatus, according to claim 1, wherein said generally hollow base member is filled with a preselected granular material so as to substantially conform in shape to a surface said apparatus is placed on.

6. The portable apparatus, according to claim 5, wherein said preselected granular material is selected from a group including pellets, peas, beans, and dried corn.

7. The portable apparatus, according to claim 6, wherein said preselected granular material is pellets.

8. The portable apparatus, according to claim 7, wherein said pellets are made of polypropylene.

9. The portable apparatus, according to claim 1, wherein said apparatus further includes a carrying handle.

10. The portable apparatus, according to claim 9, wherein said carrying handle is disposed on an end of said elongated generally hollow member.

11. The portable apparatus, according to claim 1, wherein said means for closing said elongated generally hollow member includes at least one of sewing and a zipper.

12. The portable apparatus, according to claim 11, wherein said means for closing is a zipper.

13. The portable apparatus, according to claim 1, wherein said means for securing said cup holding member to said elongated generally hollow member is an adhesive.

14. The portable apparatus, according to claim 1, wherein said apparatus includes two cup holding members.

15. The portable apparatus, according to claim 14, wherein said two cup holding members are disposed substantially adjacent each other on a same end of said elongated generally hollow member.

16. The portable apparatus, according to claim 1, wherein said foam material is selected from one of polystyrene foam and polyurethane foam.

17. The portable apparatus, according to claim 16, wherein said foam material is polystyrene foam.

* * * * *